US007099480B2

(12) United States Patent
Willems

(10) Patent No.: US 7,099,480 B2
(45) Date of Patent: Aug. 29, 2006

(54) SYSTEM FOR GENERATING SOUNDS

(75) Inventor: Stefan Marghuerite Jean Willems, Leuven (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 648 days.

(21) Appl. No.: 09/940,045

(22) Filed: Aug. 27, 2001

(65) Prior Publication Data

US 2002/0025047 A1 Feb. 28, 2002

(30) Foreign Application Priority Data

Aug. 28, 2000 (EP) ..... 00202984

(51) Int. Cl.
*H04R 5/00* (2006.01)

(52) U.S. Cl. ..... 381/18; 381/17; 381/63

(58) Field of Classification Search ..... 381/17, 381/18, 307

See application file for complete search history.

(56) References Cited

U.S. PATENT DOCUMENTS 5,199,075 A * 3/1993 Fosgate ..... 381/307
5,412,732 A * 5/1995 Kanishi et al. ..... 381/18
5,666,422 A * 9/1997 Harrison et al. ..... 381/18
6,067,360 A * 5/2000 Kasai et al. ..... 381/1
6,091,894 A * 7/2000 Fujita et al. ..... 703/13
6,122,382 A * 9/2000 Iida et al. ..... 381/18
6,385,320 B1 * 5/2002 Lee ..... 381/17
6,577,736 B1 * 6/2003 Clemow ..... 381/18
6,721,425 B1 * 4/2004 Aylward ..... 381/22

FOREIGN PATENT DOCUMENTS

WO WO9941947 8/1999
WO WO0024226 4/2000

OTHER PUBLICATIONS

By Ir. A.W.M van den Enden and et al. Entitled: "Digitale Signaalbewerking" (Digital Signal Processing), ISBN No. 90 6674 7226, Delta Press B.V., on p. 204, section 7.31 Entitled "De directe vorm I" (The direct shape I). pp. 204-205.

* cited by examiner

*Primary Examiner*—Vivian Chin
*Assistant Examiner*—Corey Chau

(57) ABSTRACT

The invention relates to a system for generating sounds with a left front loudspeaker which converts an electric signal of a left audio channel and with a right front loudspeaker which converts an electric signal of a right audio channel. Such a system for generating sounds in a room is known. The electric signals are processed such that spatial rear loudspeakers are dispensed with and the front loudspeakers generate a surround or spatial sound. According to the invention, a virtual filter generates virtual sound bodies laterally of a listener in a region between 80 and 100 degrees. Experiments have shown that the human ear is most sensitive to surrounding sound when sound sources are arranged laterally of a listener's head or when spatial sound is generated laterally of a listener.

4 Claims, 2 Drawing Sheets

SYSTEM FOR GENERATING SOUNDS

Figure 1:
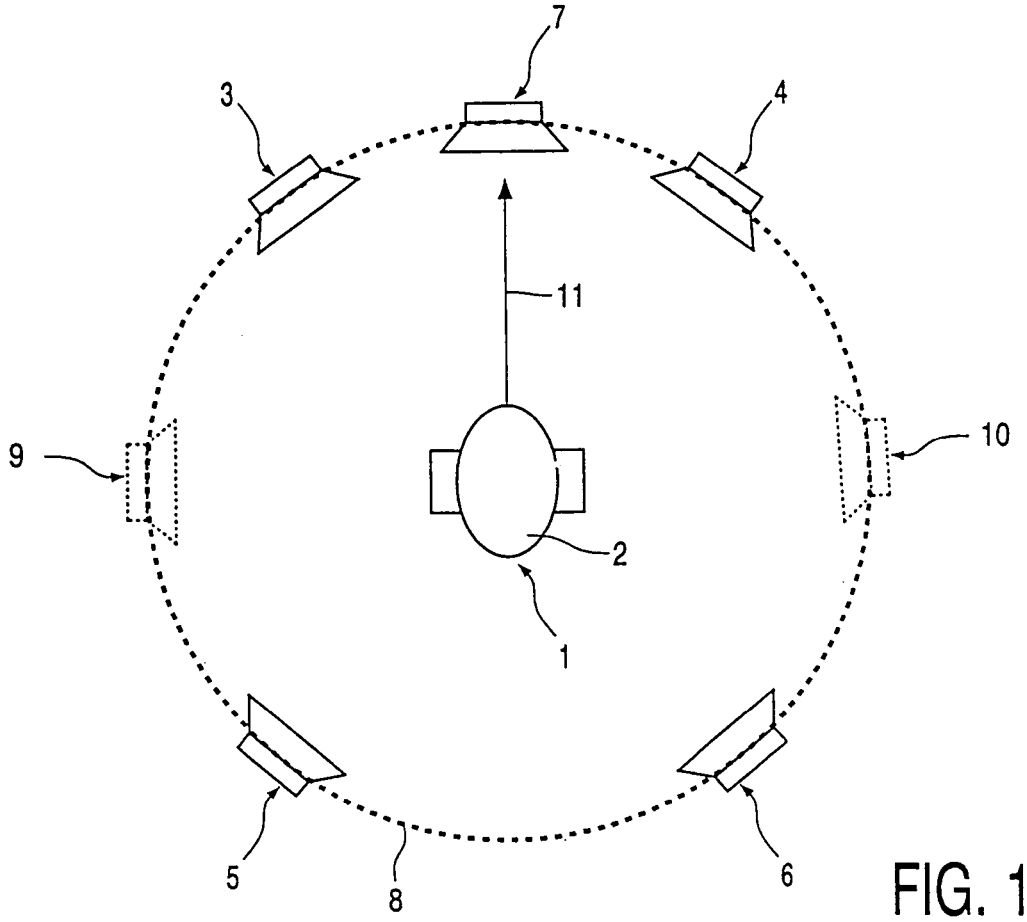

The invention relates to a system for generating sounds with a left front loudspeaker which converts an electric signal of a left audio channel and with a right front loudspeaker which converts an electric signal of a right audio channel, as defined in the preamble of claim 1.

Such a system for generating sounds in a room is known from WO 99/41947. The electric signals are processed such that spatial rear loudspeakers are dispensed with and the front loudspeakers generate a surround or spatial sound.

The invention has for its object to improve a surround sound for a listener.

This object is achieved by means of the characteristics of claim 1. According to the invention, a virtual filter generates virtual sound bodies laterally of a listener in a region between 80 and 100 degrees, preferably between 85 and 95 degrees, more in particular at 90 degrees. Research has shown that the human ear is most sensitive to surrounding sound when sound sources are arranged laterally of a listener's head or when spatial sound is generated laterally of a listener. Since the front loudspeakers are usually positioned close to audio or video devices and are accordingly in front of the listener, two virtual sound bodies are advantageously generated laterally of the listener's head, one virtual sound body for each of the two human ears.

In a simple manner, the filter comprises a sixth-order filter with an infinite pulse response. The sixth-order filter generates a spatial sound at approximately 90 degrees laterally of the head of a listener. For this purpose, the electric signal of an audio channel is applied to the filter, and the pulse response is added to the electric signal of the audio channel again by means of an adder. Two mutually independent sixth-order filters are provided for the signals of the two audio channels.

Advantageously, the virtual filter comprises a second sixth-order filter for signals which are transported from one audio channel to the other. The spatial sound impression is enhanced thereby. The second filter operates with coefficients which are different from the coefficients of the first sixth-order filter.

Advantageously, a signal of the corresponding spatial rear channel is added to the signal of an audio channel before it is applied to the filters. The signal of the left rear spatial channel is thus added to the signal of the left audio channel, and the signal of the right rear spatial channel is added to the signal of the right audio channel. The spatial sound impression is enhanced thereby.

Advantageously, the signal of the rear spatial channel is low-pass filtered before it is added to the signal of the audio channel. This means that only low frequencies, and no high frequencies, are added to the signal of the audio channel. The lower a frequency, the more difficult it is to determine its origin.

Advantageously, the signal of the rear spatial channel is passed through a delay circuit before it is added to the signal of the audio channel. A reverberation or an echo effect is achieved thereby.

An advantageous alternative is that the signal is directly supplied through a reverberation circuit.

Figure 3:
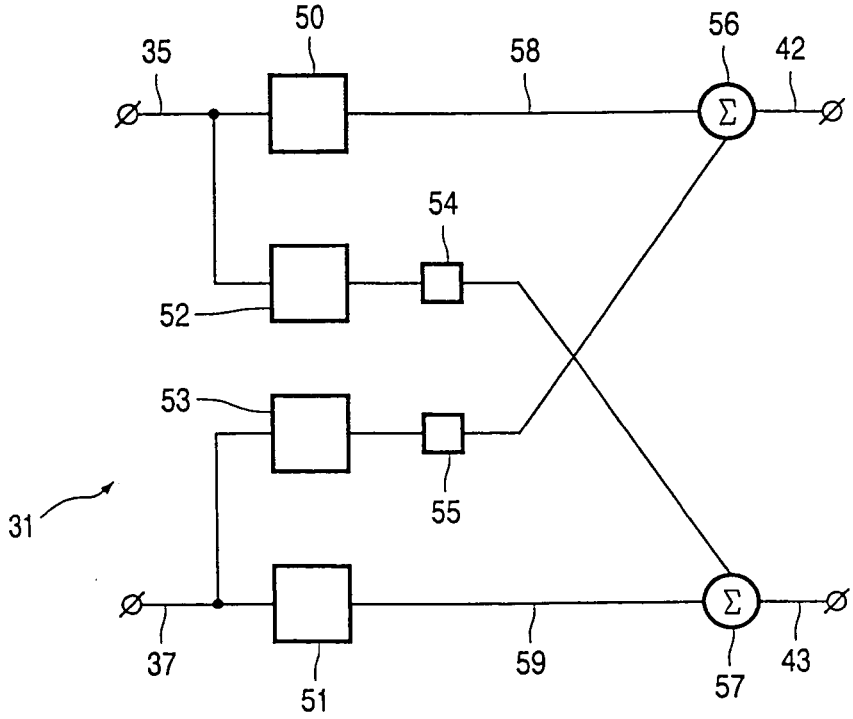
Figure 2:
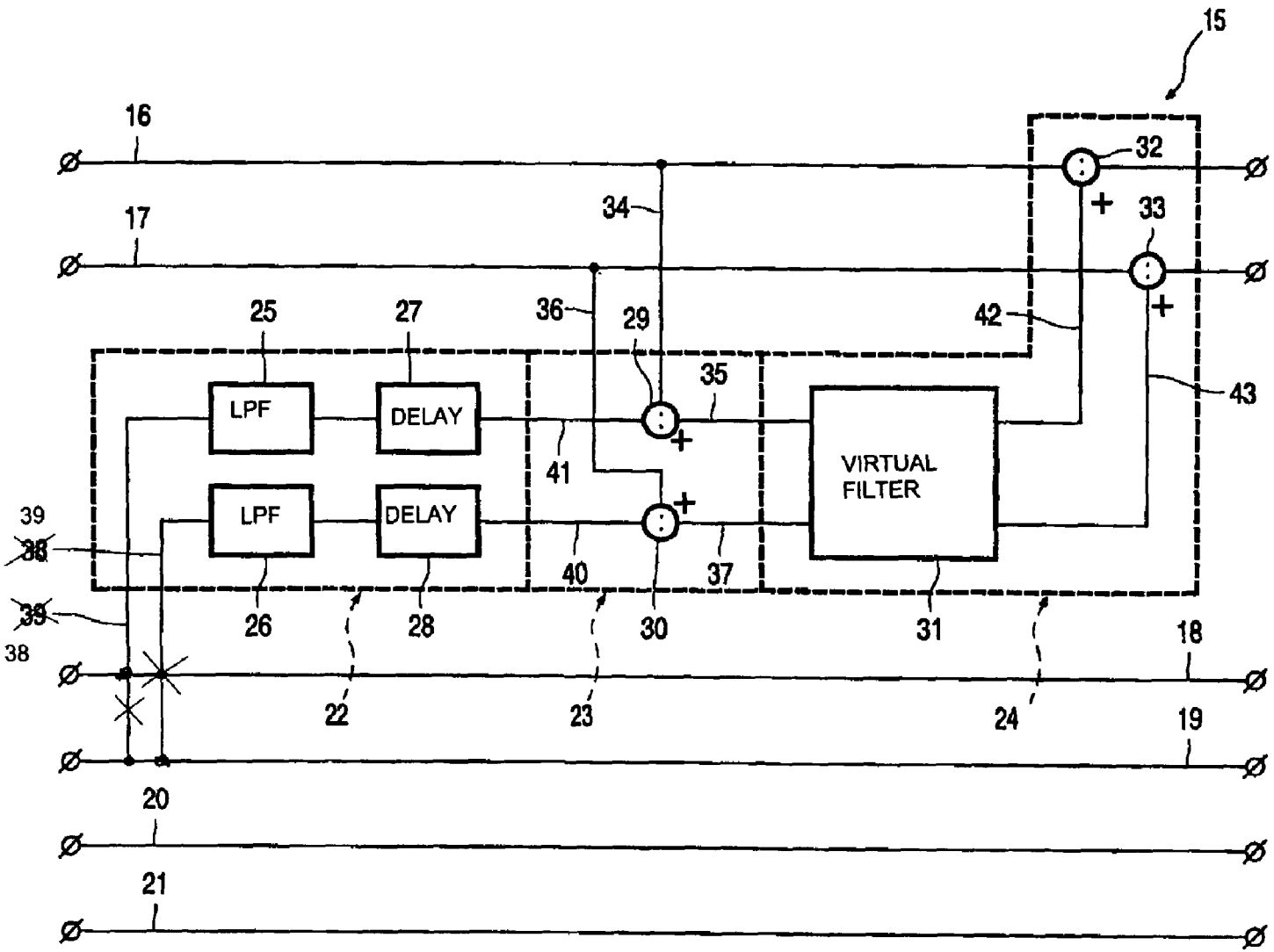

For a better understanding of the invention, an embodiment will be explained in more detail below with reference to the drawing, in which FIG. 1 shows five loudspeakers arranged around a listener's head, FIG. 2 shows a mixer for generating a spatial sound, and FIG. 3 shows a virtual filter for generating a virtual loudspeaker shifted through 90 degrees.

FIG. 1 shows a listener 1 whose head 2 is surrounded by five real loudspeakers 3, 4, 5, 6, and 7. The left front loudspeaker 3 converts an electric signal of a left audio channel. The right front loudspeaker 4 converts an electric signal of a right audio channel. The left rear surround loudspeaker 5 converts an electric signal of a left rear surround channel, and the right rear surround loudspeaker 6 converts an electric signal of a right rear surround channel. A further, central loudspeaker 7 reproduces an electric signal of a central audio channel. All these five loudspeakers are arranged at an average height which corresponds to the height of the ears of the listener 1. Sound waves and a spatial sound are generated by means of the real loudspeakers 3 and 4 in a manner as though virtual loudspeakers 9 and 10 were present around the listener 1. The listener 1 faces the central loudspeaker, thus defining a viewing direction 11. The front loudspeakers 3 and 4 are positioned at +30 and −30 degrees with respect to this viewing direction, the rear surround loudspeakers 5 and 6 at +110 and −110 degrees.

FIG. 2 shows a mixer 15 which is connected between four electrically conducting lines 16, 17, 18, and 19 for four audio channels and further lines 20 and 21 for audio channels which control a loudspeaker for low frequencies and the centrally arranged loudspeaker 7. The mixer 15 has a three-stage construction with a first mixer stage 22, a second mixer stage 23, and a third mixer stage 24. The first mixer stage 22 comprises a low-pass filter 25 and a second low-pass filter 26 as well as a first delay circuit 27 and a second delay circuit 28. Alternatively, reverberation units may be provided instead of the delay circuits 27, 28. The second stage 23 comprises two adders 29 and 30. The third mixer stage is formed by a virtual filter 31 and two further adders 32 and 33. The electric signal of the left audio channel on the line 16 is supplied to the virtual filter 31 through further lines 34 and 35. The electric signal of the right audio channel on the line 17 is also supplied to the virtual filter 31 through further lines 36 and 37. The signals of the left and right audio channels are processed in the virtual filter 31 such that the respective front loudspeakers 3 and 4 generate sounds as though sound bodies were positioned laterally of the listener in a region between 80 and 100 degrees, preferably between 85 and 95 degrees, in particular at 90 degrees. These sound bodies or sound sources are the virtual loudspeakers 9 and 10. The electric signals thus processed are mixed with the electric signals of the left and right audio channels on the lines 16 and 17 again via the two adders 32 and 33. The signal of the rear left surround channel on the line 18 and the signal of the rear right surround channel on the line 19 are derived from these lines 18 and 19 and are supplied to the two low-pass filters 25 and 26 through further lines 38 and 39. High frequencies of above 2500 Hz are filtered out in the low-pass filters 25 and 26, the frequency being limited by 6 dB per octave starting from 2500 Hz. Each signal is individually transported from the low-pass filters 25 and 26 to the respective delay circuits 27 and 28. The electric signal is delayed there. From the delay circuits 27 and 28 the signals thus processed are supplied to the adders 29 and 30 via connecting lines 40 and 41 and are mixed with the signals coming from the left and right audio channels. The signal of the left audio channel is mixed with the signal of the rear left surround channel, and the signal of the right audio channel is mixed with the signal of the rear right surround channel. The adders 29 and 30 are adjustable and are capable of adding or mixing the signals in adjustable mixing ratios. Subsequently, the electric signal of the left audio channel, which now comprises components of the signal from the rear left surround channel, reaches the virtual filter 31. Similarly, the signal of the right audio channel 17, which has now been mixed with the signal of the right surround channel, reaches the virtual filter 31. From the virtual filter 31, the processed signals reach the adders 32 and 33 via output lines 42 and 43.

FIG. 3 shows the virtual filter 31, which comprises four filters 50, 51, 52, and 53 of the sixth order, two further delay circuits 54 and 55, and two further adders 56 and 57. The filters 50 and 51 are different from the filters 52 and 53. Such filters are explained in detail in the book "Digitale Signaalbewerking" (Digital Signal Processing) by Ir. A. W. M. van den Enden and Ir. N. A. M Verhoecks, ISBN No. 90 6674 7226, Delta Press B.V., on page 204, section 7.31 entitled "De directe vorm I" (The direct shape I). The signal mixed by the adder 29 from the signals of the left audio channel and the left rear surround channel reaches a first sixth-order filter 50 via the line 35 and is passed on from there through a further connecting line 58 and the adder 56 to the output line 42. The signal of the right audio channel and the right rear surround channel, mixed in the adder 30, is passed on to a second sixth-order filter 51 via the line 37 and reaches the output line 43 via a further connecting line 59 and the adder 57. The signal mixed in the adder 29, furthermore, is mixed with the signal on the line 59 via the sixth-order filter 52, the delay circuit 54, and the adder 57. Similarly, the signal mixed in the adder 30 is mixed with the signal on the connecting line 58 by means of the adder 56 via the filter 53 and the delay circuit 55 and is supplied to the output line 42. The signals of the left and right audio channels are mixed with one another crosswise via the filters 52 and 53.

If digital signals are transmitted, an addition implies a simple summation of two values. All adders are adjustable and are capable of adding the incoming signals in adjustable ratios to one another.

LIST OF REFERENCE NUMERALS

1. listener
2. head
3. left front loudspeaker
4. right front loudspeaker
5. left surround loudspeaker
6. right surround loudspeaker
7. central loudspeaker
8. central plane
9. left virtual loudspeaker
10. right virtual loudspeaker
11. viewing direction
12.
13.
14.
15. mixer
16. line for left audio channel
17. line for right audio channel
18. line for rear left surround channel
19. line for rear right surround channel
20. audio channel for central loudspeaker
21. audio channel for base loudspeaker
22. first mixer stage
23. second mixer stage
24. third mixer stage
25. low-pass filter
26. low-pass filter
27. delay circuit
28. delay circuit
29. adder
30. adder
31. virtual filter
32. adder
33. adder
34. line
35. line
36. line
37. line
38. line
39. line
40. connecting line
41. connecting line
42. output line
43. output line
50. first sixth-order filter
51. first sixth-order filter
52. first sixth-order filter
53. first sixth-order filter
54. delay circuit
55. delay circuit
56. adder
57. adder
58. connecting line
59. connecting line

The invention claimed is:

1. A multi-channel sound system comprising:

input means for receiving input left and right front sound signals and input left and right rear sound signals;

left and right front loudspeakers for reproducing sounds corresponding to said input left and right front sound signals;

left and right rear loudspeakers for reproducing sounds corresponding to said input left and right rear sound signals;

generating means, coupled to receive said input left and right front and rear sound signals, for generating left and right virtual sound signals; and means for combining the left and right virtual sound signals and the input left and right front sound signals, respectively, to form output left and right front sound signals for application to said left and right front loudspeakers, wherein said left and right front loudspeakers reproduce both said sounds corresponding to said input left and right front sound signals and left and right virtual sounds corresponding to said left and right virtual sound signals, and said left and right rear loudspeakers reproduce said input left and right rear sound signals, said generating means generates said left and right virtual sound signals such that the left and right virtual sounds emanating from said left and right front loudspeakers appear, to a listener, to originate from virtual left and right loudspeakers positioned in a region between 80 and 100 degrees with respect to the listener, wherein said generating means comprises:

first combining means for combining said input left front sound signal with said input left rear sound signal;

second combining means for combining said input right front sound signal with said input right rear sound signal; and a virtual filter coupled to said first and second combining means, said virtual filter forming said left and right virtual sound signals, and wherein said virtual filter comprises:

a first input coupled to an output of said first combining means, and a second input coupled to an output of said second combining means;

a first sixth-order filter and a second sixth-order filter coupled to said first and second inputs, respectively;

a first combination circuit and a second combination circuit, each having a first input coupled to respective outputs of said first and second sixth-order filters, outputs of said first and second combination circuits carrying the left and right virtual sound signals;

a third sixth-order filter and a fourth sixth-order filter coupled to said first and second inputs, respectively; and first and second delay circuits coupled, respectively, to said third and fourth sixth-order filters, respective outputs from said first and second delay circuits being coupled to respective second inputs of said second and first combination circuits, wherein said first and second sixth-order filters are different from said third and fourth sixth-order filters.

2. The multi-channel sound system as claimed in claim 1, characterized in that the generating means comprises respective low-pass filters for filtering the input left and right rear sound signals.

3. The multi-channel sound system as claimed in claim 1, characterized in that the generating means comprises respective delay circuits for delaying the input left and right rear sound signals.

4. The multi-channel sound system as claimed in claim 1, characterized in that the generating means comprises respective reverberation circuits to which the input left and right rear sound signals are applied.

* * * * *